United States Patent [19]

Davis

[11] 4,005,674

[45] Feb. 1, 1977

[54] PIVOT POSITION SENSING APPARATUS

[75] Inventor: James Arthur Davis, Ripon, Wis.

[73] Assignee: Brunswick Corporation, Skokie, Ill.

[22] Filed: Sept. 4, 1975

[21] Appl. No.: 610,416

[52] U.S. Cl. ..... 115/41 R
[51] Int. Cl.[2] ..... B63H 5/12
[58] Field of Search ..... 115/41 R, 41 HT, 35; 338/176, 183

[56] References Cited

UNITED STATES PATENTS

| | | | |
|---|---|---|---|
| 3,138,777 | 6/1964 | Wormser et al. | 338/183 |
| 3,404,656 | 10/1968 | Chamberlain | 115/41 R |
| 3,641,965 | 2/1972 | Schmiedel | 115/41 HT |
| 3,834,345 | 9/1974 | Hager et al. | 115/41 HT |
| 3,844,247 | 10/1974 | Collis et al. | 115/41 HT |

*Primary Examiner*—Trygve M. Blix
*Assistant Examiner*—Gregory W. O'Connor
*Attorney, Agent, or Firm*—Andrus, Sceales, Starke & Sawall

[57] ABSTRACT

A pivot position sensor sensing outboard motor trim includes a housing within which a pair of U-shaped movable contacts are secured in axially spaced relation on an operating rod which extends outwardly of the housing. The housing is attached by the motor. The end of the rod is interconnected by a flexible cable to a clamp coupler affixed to the tilt tube or shaft. The cable extends over the collar and wraps and unwraps thereon as the motor pivots to position the rod with respect to the motor. The fixed housing is provided with a chamber having a pair of wound linear resistor units secured in longitudinal recesses on opposite sides of the chamber and engaged by one of said contacts. At ninety degrees therefrom, a pair of limit contact strips are mounted in offset recesses on opposite sides of the chamber and connected by the other contact. At a preselected up-tilted position, the limit contacts separate from the strips and open the circuit therebetween to terminate up-trim drive.

15 Claims, 4 Drawing Figures

PIVOT POSITION SENSING APPARATUS

BACKGROUND OF THE INVENTION

The present invention is directed to trim position sensing apparatus for marine propulsion devices such as outboard motors and the like.

Outboard motors, stern drives and the like are pivotally mounted to the transom of a boat. Relatively large motors are provided with automatic trim positioning controls for adjusting the angular orientation of the outboard motor about a horizontal axis. It is well-known that proper angular orientation or trim of the outboard lower unit is extremely important to provide optimum propulsion of the watercraft and particularly at maximum speed and with maximum safety. An improper trim not only can reduce the efficiency of the boat but can result in a relatively dangerous boating situation where the control of the boat is lost. For example, if proper trim position is not maintained in rough water and, particularly, at high speeds, the steering and speed control is adversely affected. If the boat is being operated in rather shallow water conditions, the unit should, of course, be tilted upwardly.

With automatic power trim positioning, automatic visual indication of the degree of trim is desirable. Various systems have been suggested for stern drives for providing the desired positioning indicating. For example, satisfactory apparatus is shown in U.S. Pat. Nos. 3,834,345 and 3,641,965 for rotary and linear sensing system. U.S. Pat. No. 3,834,345 discloses a linear rotary potentiometer sensor secured to the stern drive's pivot shaft to provide a signal related to the angular orientation of the outboard or of the lower propeller unit. Generally such devices in addition to providing indication of the trim will incorporate a separate limit switch to limit the upward trim angle of the stern dirve unit. Outboard motors have generally included cam operated trim limit switches but have not included trim sensing devices because of space limitations.

The potentiometer is coupled to an indicating gauge to establish a visual indication of the engine trim angle while the limit switch is employed in combination with the trim power positioning apparatus particularly the control circuitry thereof to limit the trim angle to which the engine can be moved by the trim-up control means.

Although such limit controls have provided highly satisfactory indication and interlocking limit of the trim angle they have generally required separate limit switches and indicating signals and have the components mounted to the exterior of the motor asembly.

SUMMARY OF THE PRESENT INVENTION

The present invention is particularly directed to a novel pivot of trim position sensor means and coupling to a marine propulsion lower unit which can be employed with an outboard motor, a stern drive and the like to detect the angular orientation thereof, and in an optimum construction, an integrated, trim sensor and trim limit switch assembly are mounted for operation by a common contact operator coupled to the pivot member.

More particularly, in accordance with a preferred and novel embodiment, the angle sensor means includes a housing within which a movable contact means is axially mounted on an operating rod member extending outwardly of the housing and including an outer flexible coupling link. The housing and flexible link are connected respectively one each to the transom bracket assembly and to the outboard motor. The flexible link is looped over the pivot or tilt shaft such that the relative pivotal tilt and trim movement of the outboard motor causes wrapping or winding and unwrapping and unwinding of the flexible link about the pivot shaft. This results in a controlled motion of the rod and armature housing. Within the housing a potentiometer is secured longitudinally of the housing and parallel to the movement of the rod. Angularly offset within the housing from such potentiometer is a limit control switch means. The movable contact means includes a potentiometer contact means and switch contact means secured to the inner end of the rod and resiliently urged to a retracted position.

More particularly in a preferred and novel embodiment of the present invention, a cup-shaped housing is fixedly secured to the motor with a rod extending outward therefrom through an outer cover. The end of the rod is interconnected by a flexible cable to a clamp coupler affixed to the tilt tube or shaft such that the cable wraps and unwraps over the tilt tube and positions the rod with respect to the motor. Thus the pin end of the flexible cable is stationary with respect to the tilt tube and mount. The fixed housing is provided with a chamber. A pair of wound resistor units are secured in longitudinal recesses in the opposite sides of the chamber. At ninety degrees therefrom, a pair of limit contact strips are mounted in offset recesses at diametrically opposite sides on the outer end of the chamber. The inner end of the rod is provided with an armature including a plurality of clamping plates or discs and continuously urged inwardly, along with the rod and cable, by a spring means. A pair of contact wipers are clamped between a pair of the armature members. The wipers may be simple spring members having an offset outer end slidably engaging the linear potentiometers. Offset 90° from the potentiometer wiper, similar limit contact wipers are slidably disposed within aligned recesses in the chamber wall, with limit terminal strips located in offset recesses in the outer end of the housing. At a preselected up-tilted position, the limit wipers with the contact strips establish an open circuit therebetween. The resulting signal terminates the up-trim drive.

The assembly can be conveniently and reliably mounted within the mounting assembly immediately beneath the outboard motor and thus provides a compact and reliable integrated indicating potentiometer and limit switch unit which is simply and rapidly mounted to the outboard motor as well as stern drives and the like.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawing.

DESCRIPTION OF THE ILLUSTRATED EMBODIMENT

Figure 1:
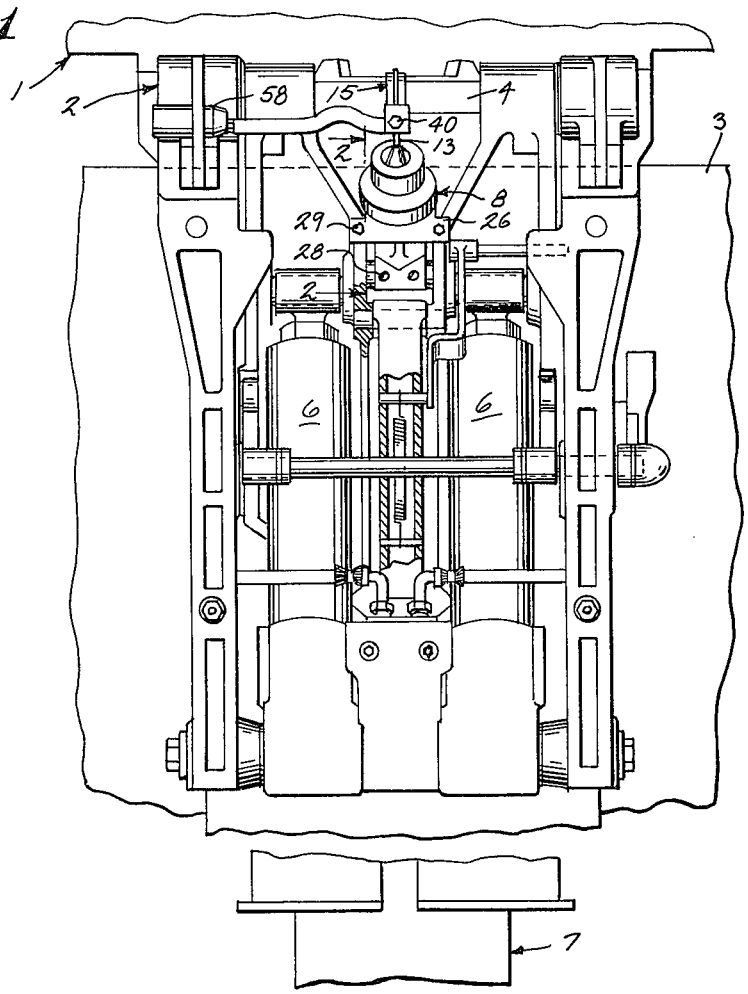
FIG. 1 is a fragmentary side elevational view of an outboard motor and swivel bracket assembly with a trim positioning sensor constructed in accordance with the present invention.
Figure 2:
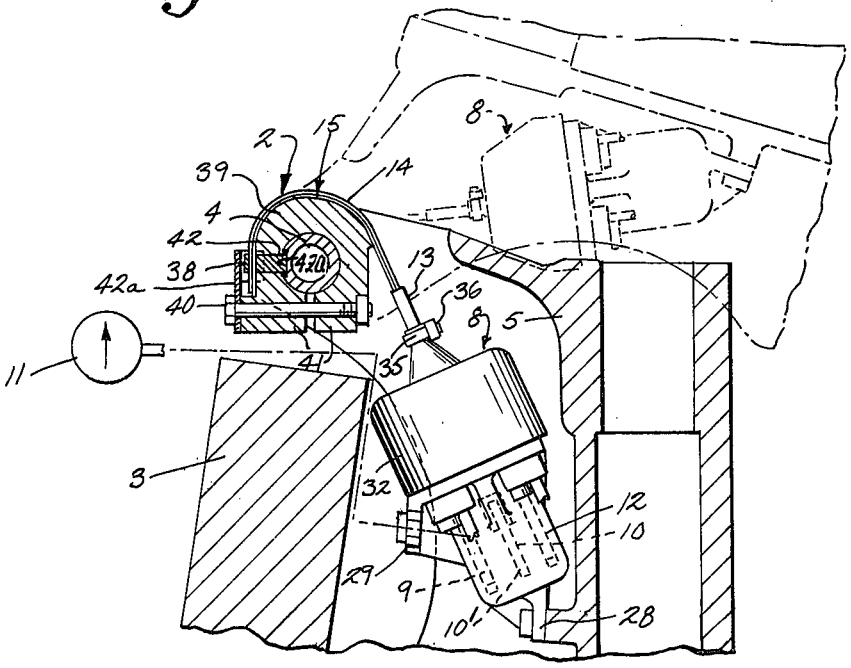
FIG. 2 is a fragmentary front elevational view of the assembly shown in FIG. 1.

Referring to the drawings and particularly to FIGS. 1 and 2, a fragmentary portion of a marine propulsion device such as an outboard motor 1 is illustrated pivotally interconnected to a transom bracket assembly 2 which is suitably releasably secured to a boat transom 3. The bracket assembly 2 includes a fixed pivot shaft or tube 4. The outboard motor 1 includes a generally U-shaped swivel bracket 5 having a suitable bushing journaled on the pivot shaft. A suitable power tilt device 6 is provided for selectively positioning of the outboard motor 1 about the pivot shaft 4 to provide controlled trim positioning of the lower propeller unit 7 relative to the transom and therefore the boat and the water. A trim sensing apparatus 8, which particularly forms the subject matter of the present invention, is mounted within the bracket assembly 2 and interconnected to the outboard motor 1, particularly bracket 5 in the illustrated embodiment, and shaft 4 to actuate a signal means 9 to provide an automatic signal indicating the trim position. The preferred apparatus 8 also includes an integrated limit switch means 10 to limit the up-trim position to a selected maximum raised angle.

The trim sensing apparatus 8 is shown coupled to a suitable indicator 11 which may be mounted to the forward end of the watercraft and provides a direct visual indication of the trim position. The output may, of course, also be coupled into an automatic servo-type positioning means such as in U.S. Pat. No. 3,834,345. In addition, the hydraulic power mechanism 6 is normally provided with a suitable control circuit, not shown, with limit switch means 10 operative to terminate operation of the power lift unit upon reaching a preselected limit, at which point the unit is held in trim position.

The bracket assembly 2, the outboard motor 1, the power tilt mechanism 6 and other associated components may be of any suitable construction but is preferably constructed in accordance with the illustration and teaching of the co-pending application entitled "HYDRAULIC POWERED TRIM AND TILT SYSTEM FOR MARINE PROPULSION DEVICES" which was filed on the same day as this application and is assigned to the same assignee. Consequently, no further description of such apparatus is given other than that which is necessary to clearly and fully understand the present invention.

Figure 4:
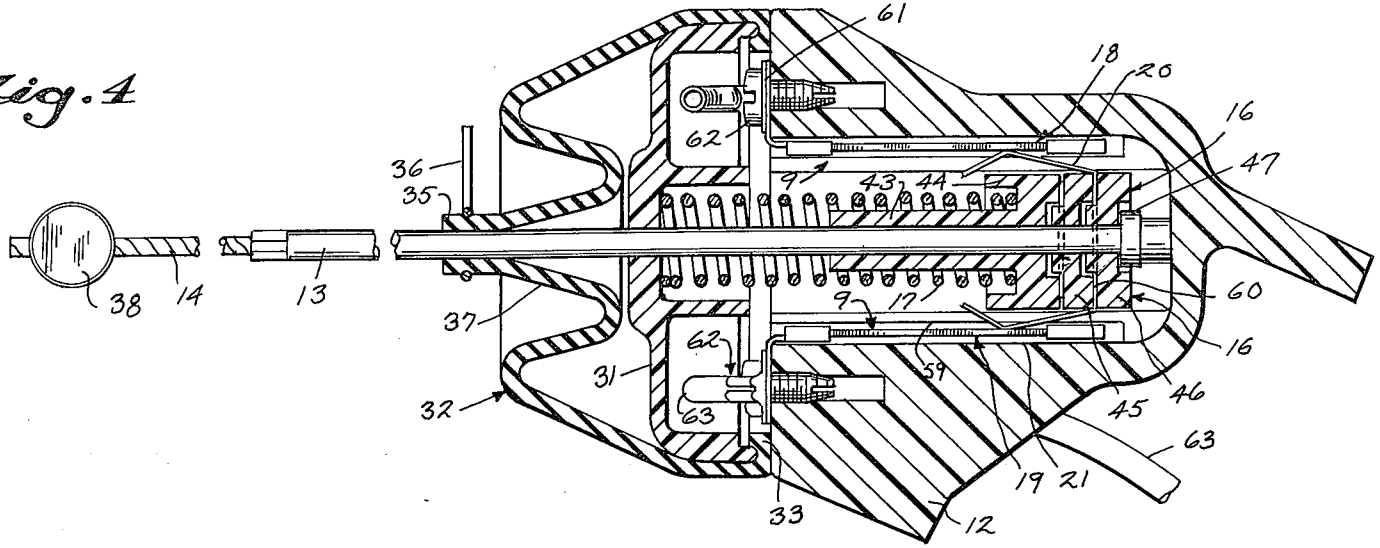
FIG. 4 is a similar longitudinal vertical section to the integrated indicator taken generally on line 4—4 of FIG. 1.

Generally, the illustrated embodiment of the sensing apparatus includes a housing 12 which is secured to the outboard motor bracket 5. An operating rod 13 projects outwardly of the housing toward the pivot shaft 4 and, in the down trip position, extends to the right of the shaft as shown in FIG. 1. A flexible cable 14 is secured to the outer end of the rod 13 and is firmly attached to the tilt tube 4 by a coupling clamp unit 15 with the cable 14 wrapped over the clamp unit. The rod 13 is slidably disposed within the housing 12 and includes an inner resiliently mounted armature assembly 16 and spring loaded by a spring 17 to the retracted position shown in FIGS. 3 and 4. Raising the motor 1 results in the pivoting of the housing 12 with the motor 1 about the axis of shaft 4, resulting in the unwrapping of the cable and movement of the armature into the housing as shown in phantom in FIG. 1. The armature assembly 16 moves relatively inwardly of the housing 12. As shown in FIG. 4, a potentiometer assembly or means 9 includes a pair of oppositely located potentiometer elements 18 and 19 secured within the housing 12 with a pair of interconnected sliding contacts or wipers 20 and 21 secured to the armature assembly 16 and engaging the potentiometer elements. The inward movement of the housing 12 varies the position of the contacts 20 – 21 on the elements 18 – 19 to correspondingly vary the resistance connected into the circuit by the potentiometer, as more fully developed hereinafter.

Figure 3:
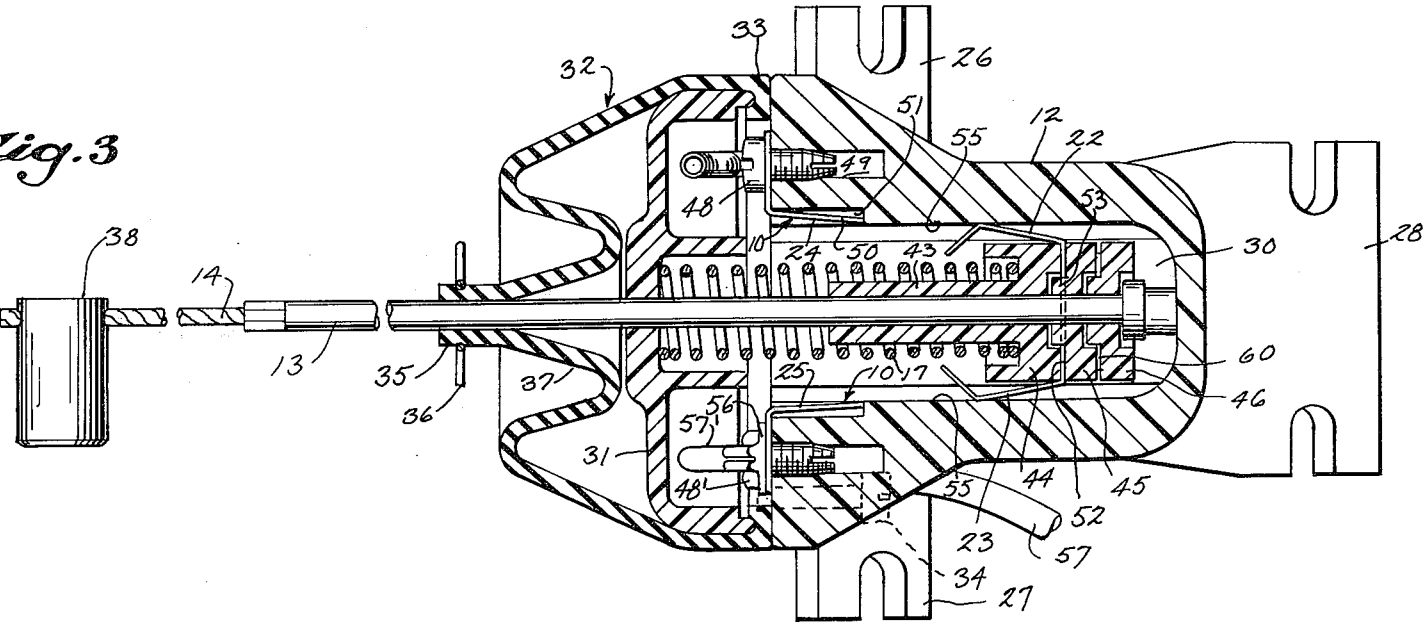
FIG. 3 is an enlarged longitudinal vertical section through the mounting assembly taken generally on line 3—3 of FIG. 2.

Generally, as shown in FIG. 3, the illustrated limit switch means 10 includes a similar pair of interconnected wiper type contacts 22 and 23 within the housing 12 rotated 90° from the potentiometer assembly 9. The switch means 10 includes fixed contacts 24 and 25 secured to the outer end of housing 12. In the retracted position, the limit switch contacts 22 – 23 are spaced inwardly from the fixed contacts 24 – 25. Upward rotation of the motor 1 to a tilt limit position causes the armature to move outwardly and connects the contacts 22 – 23 to the fixed contacts 24 – 25. Opposite rotation separates the contacts, opening the circuit therebetween to effect termination of the power tilt circuit.

The location within the bracket assembly encloses the sensor and protects it from accidental damage. The flexible cable actuating as the result of the relative winding upon the pivot shaft provides a simple and reliable mechanical coupling.

More particularly, in the preferred illustrated embodiment, the housing 12 is generally a cylindrical cup-shaped housing member formed of a suitable plastic with laterally extended top mounting brackets 26 and 27 and an end bracket 28 which are secured to the underside of the motor bracket 5 by suitable bolt means. The housing defines an open tubular chamber 30 within which armature assembly 16 is slidably mounted. The outer end of the cup-shaped housing 12 is closed by an inverted cup-shaped cover 31 with the armature rod 13 slidably mounted therein. A flexible cup-shaped boot 32 encloses the cover 31 and includes a sealing lip 33 projected between the cover 31 and the housing 12. Cover 31 is secured to housing 12 by suitable clamp screws 34 which compress lips 33 to form a liquid right joint.

The boot 32 is generally cone-shaped and includes an apex portion 35 clamped as by an encircling clamp 36 to the rod 13. Boot 32 is formed with a convolution 37 adjacent to the outer cover 31 to permit travel of the rod 13. The cover 31 and boot 32 maintain a sealed enclosure of the switching assembly.

The outer end of the rod 13 is swaged or otherwise firmly affixed to the cable 14. A pivot pin 38 is swaged or otherwise firmly staked to the outer end of the cable 14 and is connected to assembly 15 for attachment to shaft 4.

Assembly 15 includes a split clamping collar 39 encircling the shaft and having a releasable clamping bolt 40 interconnecting the collar ends 41 and firmly attaching the collar to the shaft.

The pin 38 is clamped within an opening 41*a* in the side of the collar 39 with the inner end located within an aligned notch 42 in the tilt tube 4. A clamp plate 42*a* is attached to the collar 39 and extends outwardly over the outer end of the pin 38 to firmly attach the pin and cable to the collar. Notch 42 has a circumferential length slightly greater than the pin diameter and provides for slight adjustment of the relatively fixed positioning of the pin 38 and therefor armature 16 with respect to the housing 12 to insure proper opening of the limit switch means.

The housing 12 is provided with the square chamber within which the armature assembly 16 is mounted to properly support the movable contacts. The illustrated armature assembly 16 includes a tubular guide 43 for spring 17 and terminates in a clamping plate or disc 44 generally conforming to the configuration of the chamber for guided movement within the housing. The coil spring 17 acts between the base of the cover 31 and the opposing face of the disc 44 to continually urge the armature assembly inwardly as illustrated. A pair of square contact clamping spacers or discs 45 and 46 are located between the disc 44 and a hub or enlargement 47 on the inner end of the rod 13 such that the force of the spring 17 is transmitted to rod 13. The contacts are keyed to square discs which guide them within the housing and prevent rotation.

The limit switch assembly 10 includes a pair of similarly shaped and mounted L-shaped fixed contacts 24 and 25 mounted in diametrically opposite sides of the housing 12, as shown in FIG. 3. Contact 24 is described and corresponding portions of contact 25 are identified by corresponding primed numbers. The contact 24 is secured with the one leg abutting the outer face of the housing 12 by contact screw 48 which threads into an appropriate opening 49 in the outer wall of the housing 12. The L-shaped member 24 has the second leg 50 extended over the edge of the chamber and extending inwardly in a recess 51 adjacent to the outer end of the chamber and terminal.

The contacts 24 and 25 are thus spaced radially outwardly of the armature for selective engagement with contacts or wipers 22 and 23. The wipers 22 and 23 are similarly formed with an integral base 52 to form generally U-shaped contacts. The base 52 of the contacts is clamped on the shaft or rod 13. The base 52 includes an opening mating with projection 53 on the disc 45. The contact wipers 22 and 23 are formed of a spring contact metal and extend to diametrically opposite sides within the chamber to define spring arms with the outer contact ends located within longitudinal keyways 55 in the chamber wall. The contacts 22 and 23 are thus guided for longitudinal movement and prevented from rotating within the housing 12. The longitudinal keyways 55 are aligned with contact strip recesses 51 which project radially outwardly thereof. Therefore, as the armature 16 collapses into the housing 12 the contact wipers 22 and 23 move through the keyways 55 and at a selected point, move out of engagement with the contact strips 50 and 50′. The circuit between the L-shaped contacts 24 and 25 is thus opened. The contacts are connected by suitable eyelet terminals 56 to leads 57 into the trim control circuit.

In the illustrated embodiment, the connecting leads 57 pass through the wall of the housing 12 with the inner end extending into the cup-shaped cover 31 and connected to the connecting screw by suitable lugs or terminals 56. The outer ends of the leads 57 are terminated in a suitable coupler 58 particularly adapted for marine application.

The potentiometer assembly 9, as shown in FIG. 4, includes similar wound resistor elements 18 and 19 defining elongated members located in guide recesses or keyways 59, rotated 90° within housing 12 from the limit switch contact keyways 55. The potentiometer movable contacts 20 and 21 generally are similar to the limit switch wipers and includes a square base 60 clamped between the intermediate spacer disc 45 and the outer end disc 46 to thereby electrically separate the potentiometer contacts from the limit contacts. The arms of contacts 20 – 21 extend radially and longitudinally with the outer ends thereof bending inwardly to define a line type contact with the potentiometer resistor elements 18 and 19 and thereby provide accurate engagement with only one or a few turns of the wound resistor element. The portion of wound resistors connected between the contact wipers 20 and 21 provides highly accurate positioning response varying of the reistance with the positioning of the wipers on the wound resistor assemblies.

The outer end of the resistor assemblies terminate in L-shaped terminals 61, the outer ends of which are bent over and lie adjacent to the outer face of the housing rotated 90° from the limit switch terminals 24 and 25. The terminals 61 are similarly connected by lugs and screw units 62 to potentiometer connecting leads 63 which similarly are embedded within the housing. The outer ends of the leads 63 terminate in the coupler 58 for connection to the indicating and/or control circuit in accordance with any desired system.

Applicant has found that the integrated unit with the integral potentiometer and the limit switch structure contained within a single housing and the flexible cable which is wound and unwound on the tilt tube or shaft provides a simple, reliable and relatively inexpensive sensor with means of protecting and limiting the trim positioning.

Various modes of carrying out the invention are contemplated as being within the scope of the following claims, particularly pointing out and distinctly claiming the subject matter which is regarded as the invention.

I claim:

1. A position sensor unit for a pivotally mounted marine propulsion apparatus adapted to be secured to the aft end of a boat and having a pivot support means, comprising a signal device having a support member for providing a position related output signal, mounting means for said support member for connecting of the signal device to the propulsion apparatus and thereby positioning the signal device related to said pivot support means, a rectilinear operating member slidably journaled on said support member in engagement with said signal device for changing the output signal and having an outer flexible end, and coupling means connected to said outer flexible end for attachment to the pivot support means and providing for movement of the flexible end in response to the pivoting of propulsion apparatus.

2. The position sensor unit of claim 1 having a limit switch located on said support member and having an operator coupled to the operating member.

3. The position sensor unit of claim 1 wherein said pivot support means includes a pivot pin, said outer end includes a flexible cable, said coupling means including a releasably shaft clamp means for connecting of the outer end of the cable to the pivot pin, said operating member being thereby moved relative to said support means as the cable winds onto and from the pivot pin with pivoting of the propulsion apparatus.

4. A position sensor apparatus for a pivotally mounted marine propulsion apparatus adapted to be secured to the aft end of a boat and having a pivot support shaft means, comprising a housing member, a signal device mounted within the housing member, mounting means for fixedly attaching the housing member to the marine propulsion apparatus, a rectilinear operating member journaled in said housing and having signal contact means in sliding engagement with said signal device and having an outer flexible portion adapted to extend around said pivot shaft means, and coupling means securing said flexible portion to the pivot shaft means causing said flexible portion to wind and unwind as the marine propulsion apparatus pivots.

5. The position sensor apparatus of claim 4 having a limit switch contact means located within said housing member and having second contact means coupled to said operating member within said housing member and moved into alignment with said limit switch contact means.

6. The apparatus of claim 5 wherein said housing member includes a pair of opposed, aligned recesses on opposite sides of the interior of the housing member and said limit contact means are metal strips secured within said recesses, said second contact means include a U-shaped contact including resilient contact arms in sliding engagement in alignment with said metal strips.

7. The apparatus of claim 4 wherein said signal device includes a pair of potentiometer wound resistors, said contact means including resilient contact arms in sliding engagement with said resistors.

8. The apparatus of claim 4 wherein said housing is a cup-shaped housing having an outer cover, and including a tubular sealing boot means of a flexible material having a first peripheral inner end portion clamped between the cover and housing and a second peripheral outer end portion clamped about said operating member, said boot means having an intermediate convolution permitting free movement of the outer portion of the boot means with said operating member.

9. In the apparatus of claim 4 wherein said pivot shaft means includes a fixed pivot shaft, said housing includes an outer cover closing a cylindrical opening in said housing, an armature slidably mounted within said opening and having an operating rod projecting from the outer cover and defining said operating member, said flexible portion including a flexible cable affixed to the end of the rod and extended around said shaft, a coupling collar adjustably secured to the shaft, said cable being pivotally coupled to said collar, a pair of longitudinal recesses on diametrical opposite sides of said opening in said housing, said signal device including a pair of elongated signal sources in said recesses and connected at the outer ends to an indicating lead, a U-shaped contact means secured to the operating rod and slidably engaging said sources, a second pair of longitudinal recesses on diametrical opposite sides of said opening and spaced circumferentially from said first pair, limit contact means located in said second pair of recesses, a second U-shaped contact means secured to the operating rod in spaced relation to said first U-shaped contact means and engaging said limit contact means at a selected position of said rod.

10. The apparatus of claim 9 wherein said signal sources are potentiometer wound resistors, said first U-shaped contact means including resilient contact arms in sliding engagement with said resistors, said limit contact means are metal plates secured within said second recesses, said second U-shaped contact means including resilient contact arms in sliding engagement with said second recesses.

11. The apparatus of claim 10 including a tubular sealing boot means of a flexible material having a first peripheral inner end portion clamped between the cover and housing and a second peripheral outer end portion clamped about the rod, said boot means having an intermediate convolution permitting free movement of the outer portion of the boot means with the rod.

12. In an outboard motor apparatus, a transom bracket assembly having an upper pivot shaft, an outboard motor bracket pivotally mounted on said shaft, a trim position sensor having a housing secured to said bracket, said housing having an outer cover closing an opening in said housing, an armature slidably mounted within said opening and having an operating rod projecting from the housing cover, a flexible cable affixed to the end of the rod, a coupling collar adjustably secured to the shaft, said cable being wrapped over the collar and firmly affixed to said collar, a pair of longitudinal recesses on opposite sides of said opening, a pair of elongated potentiometers in said recesses and connected at the outer ends to signal leads, a U-shaped contact means secured to the operating rod and slidably engaging said potentiometers, a second pair of longitudinal recesses angularly spaced from said first pair, limit contact means located in said second pair of recesses, a U-shaped contact means secured to the operating rod in spaced relation to said first U-shaped contact means and engaging said limit contact means at a selected position of said rod.

13. In the outboard motor of claim 12 wherein said cable includes a pin extending through an opening in said collar and into an adjustment limit notch in said shaft.

14. The position sensor unit of claim 1 wherein said pivot support means includes a pivot pin, said outer end includes a flexible cable, said coupling means encircling said pivot pin, said cable being wound over said coupling means and firmly affixed thereto.

15. The position sensor unit of claim 14 wherein said coupling means includes a collar adjustably attached to the pivot pin, said cable being wound on said collar, a clamping pin extending from the cable through said collar into a notch in the pivot pin, said notch being constructed to limit the adjustable positioning of said collar on said pivot pin.

* * * * *